US006772885B2

(12) United States Patent
Bourke

(10) Patent No.: US 6,772,885 B2
(45) Date of Patent: Aug. 10, 2004

(54) ROTOR FOR FLOTATION MECHANISM AND METHOD FOR DIRECTING MATERIAL FLOW IN FLOTATION MACHINE

(75) Inventor: Peter Bourke, Forrestfield (AU)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/332,335

(22) PCT Filed: Jul. 19, 2001

(86) PCT No.: PCT/FI01/00679

§ 371 (c)(1),
(2), (4) Date: Sep. 19, 2003

(87) PCT Pub. No.: WO02/07891

PCT Pub. Date: Jan. 31, 2002

(65) Prior Publication Data

US 2004/0112835 A1 Jun. 17, 2004

(30) Foreign Application Priority Data

Jul. 21, 2000 (FI) ..... 2001699

(51) Int. Cl.[7] ..... B03D 1/16; B01F 3/04
(52) U.S. Cl. ..... 209/169; 261/87; 209/164
(58) Field of Search ..... 209/164, 169; 261/87

(56) References Cited

U.S. PATENT DOCUMENTS 2,393,976 A * 2/1946 Daman et al. ..... 209/169
2,767,965 A * 10/1956 Daman ..... 261/87
2,892,543 A 6/1959 Daman ..... 209/169
4,078,026 A 3/1978 Fallenius ..... 261/87
4,800,017 A * 1/1989 Krishnaswamy et al. ... 210/219
5,591,327 A 1/1997 Walters ..... 209/169

FOREIGN PATENT DOCUMENTS

| | | | | |
|---|---|---|---|---|
| EP | 0 287 251 A2 | | 10/1988 | ..... B03D/1/20 |
| GB | 832526 | * | 4/1960 | |
| SU | 904788 | * | 2/1982 | |
| SU | 1273174 | | 11/1986 | ..... B03D/1/16 |

* cited by examiner

*Primary Examiner*—Thomas M. Lithgow
(74) *Attorney, Agent, or Firm*—Morgan & Finnegan, LLP

(57) ABSTRACT

The invention relates to a rotor used in the flotation mechanism in the concentration of ores. According to the invention, upper part of the rotor chambers under the rotor cover are formed to be downward inclined from the outer edge of the chambers into the core so that they form an angle between 5 to 70 degrees with the horizontal plane. In addition the upper surface of the rotor cover can be inclined upwards raising from around the rotor shaft towards the outer edge at an angle between 5–70 degrees. With the means inside and above the rotor the slurry is directed upwards through the stator of the flotation mechanism. The developed rotor improves the suspension of coarse particles with high specific gravity within a flotation machine. The invention relates also to a method for inverting the material flow disharging from the rotor.

8 Claims, 3 Drawing Sheets

PRIOR ART

Figure 1:
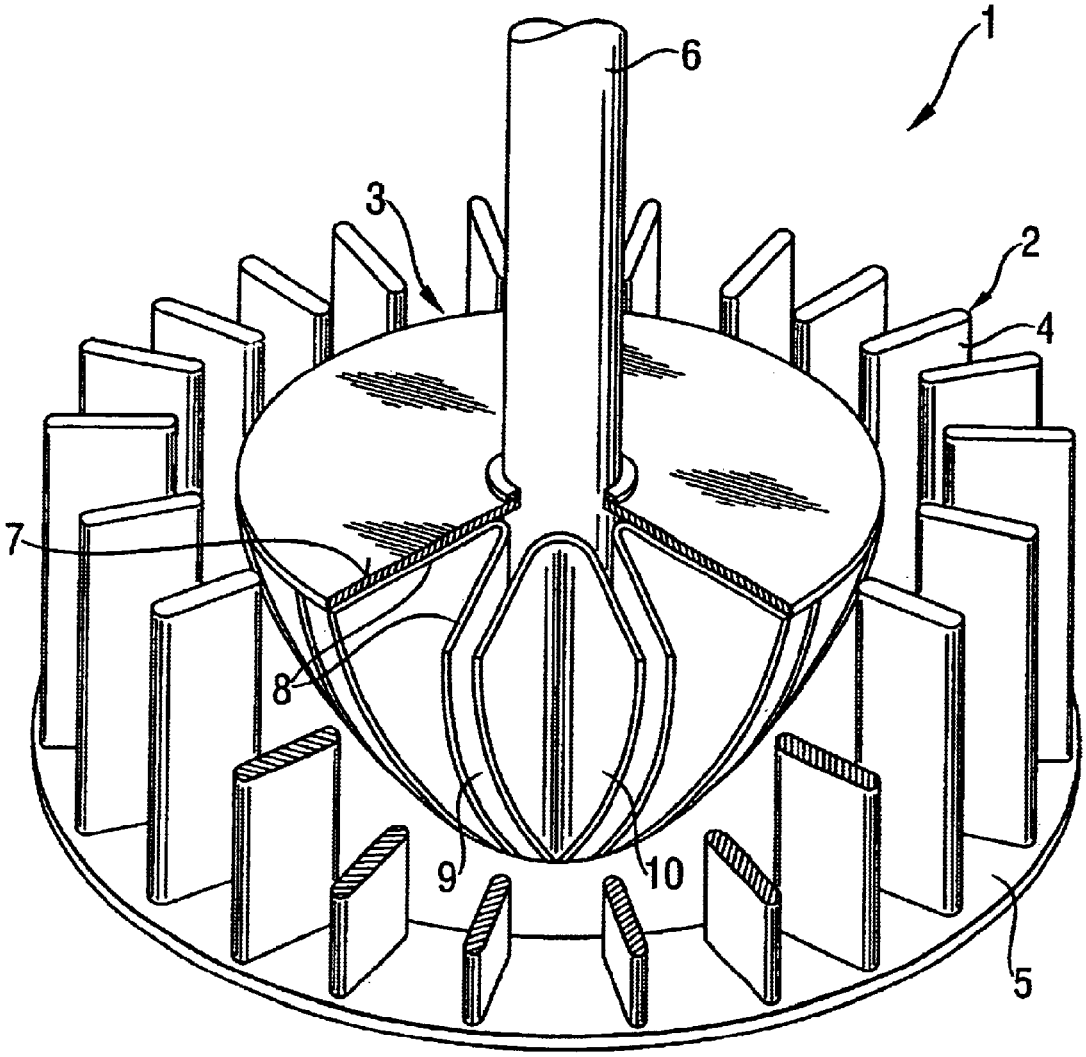

ROTOR FOR FLOTATION MECHANISM AND METHOD FOR DIRECTING MATERIAL FLOW IN FLOTATION MACHINE

The present invention relates to a rotor used in the flotation mechanism in the concentration of ores. According to the invention, upper part of the rotor chambers under the rotor cover are formed to be downward inclined from the outer edge of the chambers into the core so that they form an angle between 5 to 70 degrees with the horizontal plane. In addition the upper surface of the rotor cover can be inclined upwards raising from around the rotor shaft towards the outer edge at an angle between 5–70 degrees. With the means inside and above the rotor the slurry is directed upwards through the stator of the flotation mechanism. The developed rotor improves the suspension of coarse particles with high specific gravity within a flotation machine. The invention relates also to a method for inverting the material flow discharging from the rotor.

Flotation is essentially a three phase process involving the mixing of finely ground solids, and air to concentrate valuable minerals from gangue by floating one away from the other. Upstream to this process, water is added to the ore and fed to a comminution circuit whereby the ore is broken down and reduced in size to form a finely ground solid/liquid mixture called a slurry or pulp. The slurry is then further processed through a group or bank of flotation devices which have flotation mechanisms suitable for keeping the slurry mixture suspended while at the same time air is induced through the mechanism and dispersed evenly throughout the cell.

Suitable reagents are also added to the process that are capable of coating the surfaces of the valuable minerals to make their surfaces hydrophobic and so promote bubble/particle attachment. Once the valuable mineral particles attach to an air bubble they slowly rise to the cell surface to form a stable froth zone. This froth containing the valuable minerals is then recovered via a launder system to complete the flotation process.

For those who are experienced in the art it is generally accepted that a flotation device can be broken down into the following zones:1) a mixing zone, 2) a quiescent zone, 3) an enrichment zone and 4) a froth zone.

The mixing zone is located in the lower region of the flotation device where there is a significant zone of turbulence created by the high velocity pulp flows exiting the flotation mechanism. The quiescent zone is directly above the mixing zone and is a region where the secondary pulp (slurry) flows are of a much lower velocity and promote the upward movement of valuable mineral particles attached to air bubbles. The enrichment zone is directly under the froth zone and can extend 4 to 6 inches below the froth/pulp interface.

As the secondary pulp flows move across the cell directly underneath the enrichment zone these air bubbles together with their mineral load get the opportunity to rise up due to their inherent buoyancy and transfer into the enrichment zone before the pulp flow is redirected downwards and back into the mixing zone to repeat the cycle. Once these valuable mineral particles attached to air bubbles enter the enrichment zone the probability is high that these particles will continue to rise into the froth zone and be recovered via the launder system. However, some "dropback" of valuable mineral does occur and as a consequence these particles return into the secondary flows to repeat the process if they do not collide and reattach themselves to another air bubble in the meantime.

While it is accepted that the froth zone, quiescent zone and enrichment zone are also important regions within a flotation cell it goes without saying that the mixing zone is the most important region within a flotation device for it is in this region that particle suspension and air dispersion takes place. If the flotation mechanism fails to properly disperse the air throughout the cell or if the solids suspension is inadequate then the flotation process suffers and the overall recovery of the desired minerals will be less.

A very common type of flotation mechanism consists of a rotating rotor and stator blades around the rotor. Air is fed near the rotor for example through the rotor shaft. As a result of flotation, valuable mineral particles attach to air bubbles and accumulate in a froth In the upper part of the flotation cell and is discharged through a launder of the cell. Tailings of the slurry are directed to the next separation step.

In the U.S. Pat. No. 4,078,026 there is described a rotor-stator mechanism where the rotor has both slurry and air slots separately. The main idea of the mechanism is that the rotor creates a dynamic pressure that compensates for the hydrostatic pressure developed across the height of the rotor so that the total pressure caused by the slurry to the dispersion surface is substantially equal over said surface. The main type of said mechanism is so-called OK-rotor, whose form in vertical section is downward tapered and in which vertical rotor blades are so arranged that they form separate slurry slots and air slots between the blades. Air is pumped through the hollow rotor shaft into the air slots. The rotor has a horizontal cover plate above the blades which deflects both the slurry and air flows exiting the slots in a predominantly horizontal direction. Stator vanes are predominantly vertical and help eliminate the rotational component of the flow from the rotor.

Another flotation mechanism is described in U.S. Pat. No. 4,800,017 which seems very similar to the above-mentioned system except that the function of the slots is different. The rotor body includes a horizontal top plate and a plurality of vertically oriented rotor blades which form pump chambers. Air is pumped to each chamber for aerating the pulp of the flotation cell. The stator blades are deflected outwardly from their upper part, the lower part being vertical. The discharge of the slurry flow exiting the rotor is predominantly horizontal. However, the stator incorporates a deflector vane which effectively deflects this flow downwards at approximately 15 degrees.

In the EP patent 844 911 the rotor has a horizontal barrier in the middle of the pumping chambers which again deflects both the upward and downward flows entering the rotor in a predominantly horizontal direction when discharged.

It is also know before a flotation machine which has a plurality of vertical oriented plates which form the pumping chambers. Air is pumped to each chamber via a vertical downcomer which also incorporates and supports a horizontal shroud directly above the rotor. This shroud also supports the vertical stator blades. While the slurry flow entering the rotor is initially deflected upwards as it exits the rotor pumping slots it is deflected horizontally by the overhung shroud and is pumped radially outwards through the stator blades.

In all the mechanisms described above the slurry and air flow is directed horizontally from the rotor towards the stator blades. The mechanisms are effective in the flotation of normal size particles which means that their size is less than $P_{80}$=180 $\mu$m (80% of the material passes a sieve of 180 $\mu$m). However their performance deteriorates as the particle size and specific gravity of the mineral particles to be floated increases past this point It is also difficult to suspend particles whose specific gravity is above 3.5 t/m$^3$. It is the object of the present invention to overcome or substantially ameliorate drawbacks of the prior art and to achieve a flotation machine whereby coarse and high specific gravity material can be effectively suspended within the mixing zone using a new style of rotor that is capable of varying the mixing flow patterns within the cell.

A new type rotor of a flotation mechanism is now developed especially for a material which is coarse and has a high specific gravity. It has been proved that a vertical section downward tapered rotor which is equipped with means to direct the slurry flow upwards instead of horizontal direction allows the rotor to vary the mixing flow patterns within the machine and without interfering with the upper enrichment and froth zones within the cell. The angle of the means with the horizontal plane is between 5 and 70 degrees, preferably between 5 and 40 degrees. It is preferable that there are also means in two levels and then it is advisable they have essentially same angle. The invention relates also to a method to incline slurry flow essentially at the same angle as that of the means itself. The essential features of the invention are apparent in the claims enclosed.

According to the invention, the flotation machine is formed of a stator having mainly vertical stator blades and a rotor which is in vertical section downward tapered and the vertical rotor blades form chambers (slots). Air is conducted to the machine through the rotor shaft and directed through the chambers into the slurry. The chambers can be common both for slurry and air or there can be separate chambers for air and slurry. The rotor blades are covered with a cover plate which reaches to the outer edge of the blades. The upper part of the chambers under the cover are now formed to be downward inclined from their outer edge into the core so that they form an angle between 5 and 70 degrees with the horizontal plane. This means that the slurry flow is inclined upwards in the chambers instead of normal horizontal direction and so the slurry flow discharging the rotor directs according to the angle of the upper part of the chamber. Secondly, it is also preferable that the rotor is equipped with means for turning the slurry flow above the rotor and then the upper surface of the rotor cover is formulated so that its outer edge is raised with proportion to the inner edge around the shaft. It is cleat that the means can be constructed so that their surface towards the slurry is either straight or curved, concave or convex.

In practice the cover of the rotor can be formed so that its outer edge reaches to the outer edge of the rotor blades but the rotor cover itself is inclined upwards. However, a conventional rotor can be modified to the rotor according to the invention simply by equipping the normal horizontal cover plate of the rotor with additional means which change the upper part of the chambers and the surface part of the rotor cover plate.

Modifying of the upper part of the chambers can take place by inserting each chamber a plate located in between the rotor blades that form the chambers. The plates are joined at their outer terminal edge to the horizontal cover plate and extend downwardly at a selected angle to their inner edge until they intersect with the vertical rotor blades in the core of each chamber. Inclining the upper part of the horizontal rotor cover can take place equipping the rotor cover with another plate situated above the rotor cover. The upper plate is directed upwards from the level of the cover plate so that around the shaft this annular outer surface plate is attached to the rotor cover plate and at its outer edge said plate is raised by a vertical plate extending up from the cover plate said plate running coaxially with that of the shaft. The outer surface plate has a sloping surface formed like a cone. For example, a conventional OK-rotor can be equipped with means or plates which limit only pumping chambers and separate air chambers reach to the horizontal cover plate.

The conventional OK-rotor does not have the upper part of the pumping chambers inclined nor does it have an inclined top surface Now the main idea of U.S. Pat. No. 4,078,026 is still in force, e.g. constant pressure prevails over the entire dispersion surface which means that the air dispersion is even along the whole height of the rotor. If the pumping or air chambers open above the horizontal plane and take the form of the outer surface plate then it means that the pressure in outer top region of the rotor is not equal with the pressure In the other dispersion surface below and as consequence air dispersion efficiency will be less since the air will exit the rotor in the region of lower pressure.

Figure 2:
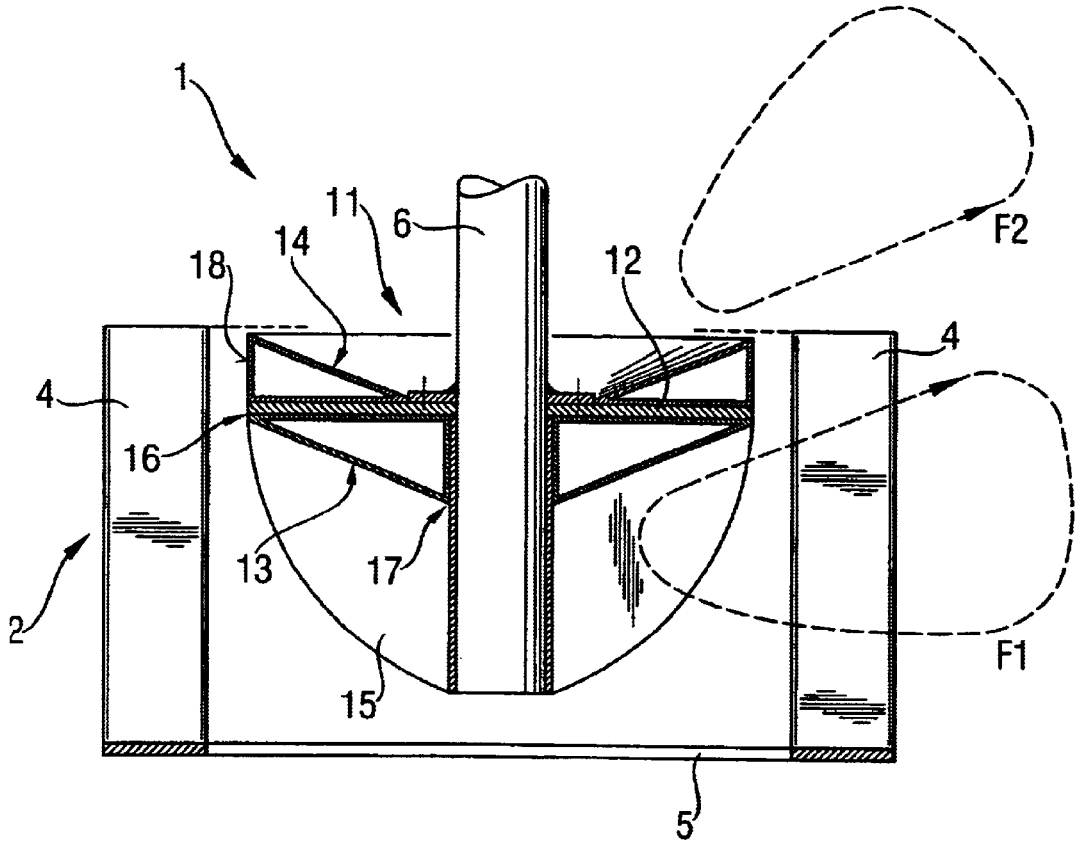
Figure 3:
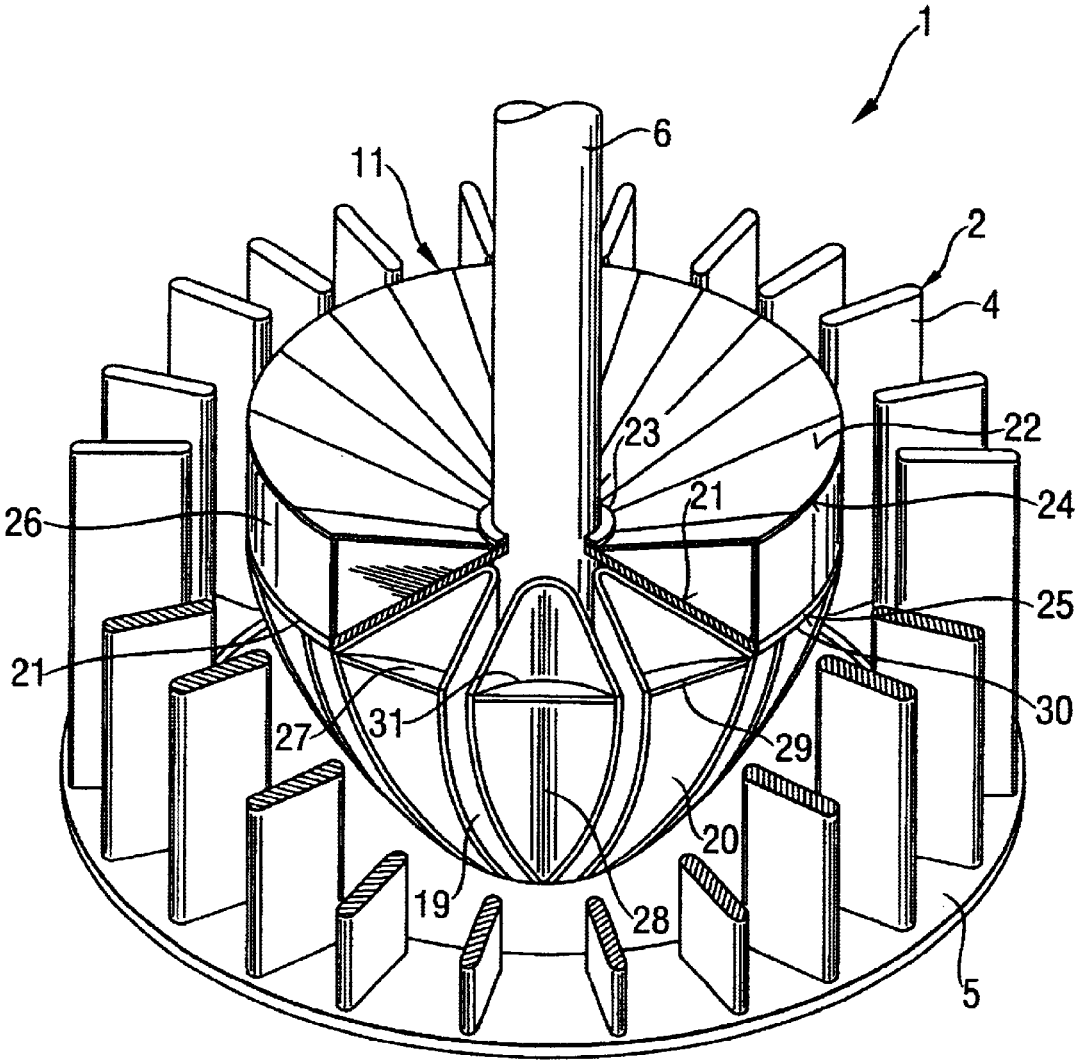

The flotation machine according to the invention is illustrated in more detail with the aid of figures, where FIG. 1 is an oblique axonometric principle diagram of the flotation mechanism of the prior art, FIG. 2 is a vertical section of the flotation mechanism of the invention, and FIG. 3 is an oblique axonometric principle diagram of the flotation mechanism of the invention.

In figure 1, a flotation mechanism 1 forms of a stator 2 and a rotor 3 inside the stator. The stator has essentially vertical stator blades 4 radially around the rotor. The stator blades are fixed on a base plate 5 which again is supported to the bottom of the flotation machine (not in the figure). The rotor described is a typical OK-rotor in which the rotor suspends from a hollow rotor shaft 6 and pressure air for dispersing into the slurry in the cell is pumped through the shaft. The rotor itself is formed of a horizontal cover plate 7 and rotor blades 8 attached to the cover. The vertical section of the rotor is a downward tapered cone. The blades 8 are essentially vertical and they are arranged so that there form air chambers 9 through which the air is pumped to the slurry. Pumping chambers 10 for slurry are in between each air slots. The cover plate is attached from its inner edge around the shaft. The direction of the slurry discharged from the rotor is mainly horizontal.

FIG. 2 describes a flotation mechanism according to the invention. The flotation mechanism 1 is formed of a stator 2 with vertical stator blades 4 and a base plate 5 and of a rotor 11. The vertical section of the rotor 11 is a downward tapered rotor with chambers but a horizontal cover plate 12 above the rotor blades is equipped with aligning means 13 and 14. The aligning means 13 achieve an inclination downwards at an angle of between 5–70 degrees below the cover in the chambers 15 and an aligning means 14 upwards above the cover. With the means 13 the chambers 15 of the rotor are formulated so that at the outer and upper edge 16 the chambers reach to the horizontal cover plate 12 but towards the core 17 of the chamber the height of the chambers decreases depending on the angle of the means 13. With the means 14 the upper surface of the rotor cover is inclined upwards so that it raises from around the shaft 6 towards the outer edge 18 at an angle of between 5–70°. The outer edge of the rotor cover with its means is essentially vertical. The figure is explained in a way how an existing rotor cover is modified but it is clear that the cover plate can be constructed to its form in manufacturing stage.

According to the method of this invention, the additional means inclined as described above collectively result in both the primary F1 and the secondary F2 flow being deflected upwards and they give a nett resultant upward flow pattern rather than the previous existing horizontal flow pattern referred In the prior art.

FIG. 3 shows an example to modify a conventional OK-rotor according to the invention. The flotation mechanism 1 is formed of a stator 2 with vertical stator blades 4 and a base plate 5 and of a rotor 11. The vertical section of the rotor 11 is a downward tapered OK-type rotor with air slots 19 and pumping chambers 20. The horizontal cover plate 21 above the rotor blades is equipped with an additional upper surface plate 22 which is annular and is attached to the cover plate at its inner edge 23 around the shaft 6. The outer edge 24 of the upper surface plate is joined to the outer edge 25 of the cover plate 21 with the aid of a vertical plate 26 running coaxially with that of the shaft. The outer surface plate is inclined upwards at an angle of between 5–70 degrees. Each pumping chamber 20 is equipped with an additional plate 27 which is inclined downwards toward the core 28 of the pumping chamber. The outer perimeter 29 of the slurry directing plate. 27 extends to the upper edge 30 of the chamber 20 and to the outer edge 25 of the cover plate underneath it and the plates are joined together. The slurry directing plate 27 is joined by its sides to the rotor blades which form the pumping chamber and the inner edge 31 of the directing plate reaches to the core of the chamber. It is preferably that the slurry directing plates have the same angle as the outer surface plate. If a rotor has common chambers for air and slurry the plates described above can be installed to each chambers.

It is now possible to improve the mixing capability of the flotation mechanism to successfully treat especially coarse material with higher specific gravity while at the same time not affecting the air dispersion ability of the rotor. While the primary mixing zone is extended further upwards into the quiescent zone of the flotation cell the subsequent increases in secondary flows have not had any measurable effects on the stability of the froth zone. The method is preferable for example in flotation of iron ore, tantalite, apatite etc.

What is claimed is:

1. A rotor of a flotation mechanism for concentrating of ores comprising the flotation mechanism being formed of a stator with its blades around a downward tapered rotor suspended on a hollow shaft and the rotor being equipped with a substantially horizontal cover plate and essentially vertical rotor blades which form chambers inside the rotor, air being conducted through the shaft to the chambers, wherein the upper parts of the chambers under the rotor cover plate having aligning means that are downward inclined from their outer edges into the core of the chambers so that they form an angle between 5–70 degrees with the horizontal plan an annular upper surface plate mounted on and the upper surface of said rotor cover plate and said upper surface plate being inclined upwards raising from around the shaft towards the outer edge of the rotor cover plate at an angle between 5–70 degrees with the horizontal plane.

2. A rotor according to claim 1, wherein chambers of the rotor are equipped with a slurry directing plate underneath the cover plate, which directing plate is joined from the outer edge to the cover plate and from other sides to the rotor blades, the directing plate reaching downward to the core of the pumping chamber at an angle between 5–70 degrees.

3. A rotor according to claim 1, the rotor blades form separate air chambers and pumping chambers of which the upper parts of the pumping chambers under the rotor cover plate are downward inclined from the outer edges of the rotor cover into the core of the pumping chambers so that they form an angle between 5–70 degrees with the horizontal plane.

4. A rotor according to claim 1, the upper surface plate is joined at its outer edge to the outer edge of the rotor cover plate with the aid of a vertical plate.

5. A rotor according to claim 1, wherein the surface of aligning means towards the slurry is straight.

6. A rotor according to claim 1, wherein the surface of aligning means towards the slurry is curved, concave or convex.

7. A method for directing a slurry flow in a mixing zone of a flotation machine with the aid of a flotation mechanism said flotation mechanism comprises a stator around a rotor, the rotor being equipped with a substantially horizontal cover plate and essentially vertical rotor blades which form chambers, wherein the upper parts of the chambers under the rotor cover plate have aligning means that are downwardly inclined from the outer edges into the core of the chambers so that they form an angle between 5–70 degrees with the horizontal plane, and an annular upper surface plate mounted on the upper surface of the rotor cover plate, and said upper surface plate being inclined upwards raising from around the shaft towards the outer edge of the rotor cover plate at an angle between 5–70 degrees with the horizontal plane;

directing slurry flow below the rotor cover plate upwards and outwardly from the rotor and directing slurry flow above the rotor plate upwards and outwardly from the rotor.

8. A method according to claim 7, wherein the coarse particles have a size above $P_{80}$=180 $\mu$m.

* * * * *